United States Patent [19]

LaCoste

[11] 4,326,716

[45] Apr. 27, 1982

[54] POLYURETHANE GOLF CLUB

[75] Inventor: François R. LaCoste, Neuilly, France

[73] Assignee: Patentex, S.A, Fribourg, Switzerland

[21] Appl. No.: 94,749

[22] Filed: Nov. 15, 1979

[51] Int. Cl.[3] ..... A63B 53/04

[52] U.S. Cl. ..... 273/167 R; 273/DIG. 8

[58] Field of Search ..... 273/77 R, 167 R, 173, 273/326, DIG. 1–DIG. 8, 73 F, 82 R

[56] References Cited

U.S. PATENT DOCUMENTS

| | | | |
|---|---|---|---|
| 745,044 | 11/1903 | Dunn | 273/78 |
| 2,457,084 | 12/1948 | Kearsley et al. | 273/167 F |
| 2,486,952 | 11/1949 | Kearsley et al. | 273/167 F |
| 2,766,047 | 10/1956 | Karns | 273/173 X |
| 3,188,302 | 6/1965 | Lorenz | 273/DIG. 8 |
| 3,266,805 | 8/1966 | Bulla | 273/78 |
| 3,390,881 | 7/1968 | Senne | 273/DIG. 1 |
| 3,456,037 | 7/1969 | Hoeschele | 273/DIG. 8 |
| 3,482,836 | 12/1969 | Smith | 273/DIG. 8 |
| 3,507,495 | 4/1970 | Tucker et al. | 273/326 |
| 3,571,900 | 3/1971 | Hardesty | 273/DIG. 8 |
| 3,693,978 | 9/1972 | East | 273/167 F |
| 3,937,474 | 2/1976 | Jepson et al. | 273/DIG. 8 |
| 3,979,126 | 9/1976 | Dusbiber | 273/DIG. 8 |

FOREIGN PATENT DOCUMENTS

| | | | |
|---|---|---|---|
| 52-49131 | 4/1977 | Japan | 273/167 R |

OTHER PUBLICATIONS

DuPont: Development Products Report No. 12, Oct. 1958, pp. 1–7.

*Primary Examiner*—Richard J. Apley
*Attorney, Agent, or Firm*—F. W. Guay & Associates

[57] ABSTRACT

High performance one-piece solid molded polyurethane vulcanizate golf club heads having a unitary body including the entire front striking face and exhibiting specific properties by virtue of the vulcanizate; and golf clubs comprising the combination of said heads each with a golf shaft.

10 Claims, 2 Drawing Figures

POLYURETHANE GOLF CLUB

BACKGROUND

As is well known, the game of golf is played with a set of clubs of varying lengths, the longest of these being called "woods" and the relatively shorter clubs being called "irons". As is also well known, a golf club comprises a shaft which has wrapping at one end thereof to form a "grip", the wrapping being leather, a rubber composition, or the like. At the other end of the shaft is attached a so-called "head", which is the striking element when swung into a golf ball.

The shaft may be made of metal (e.g., steel), graphite, glass fiber, or the like. As suggested, supra, the longer clubs of a set generally have heads made of wood and the relatively shorter clubs usually have heads made of iron.

Figure 1:
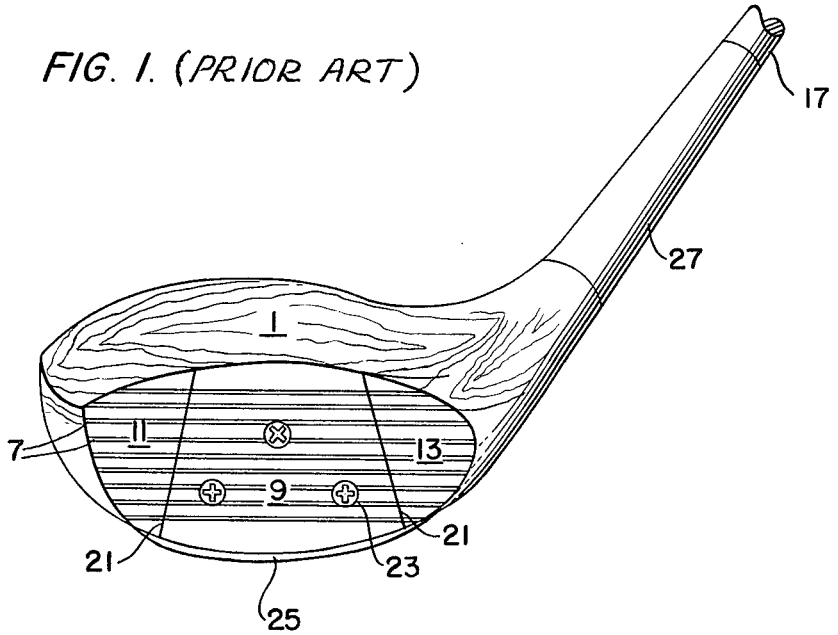
FIG. 1. (PRIOR ART)
Figure 2:
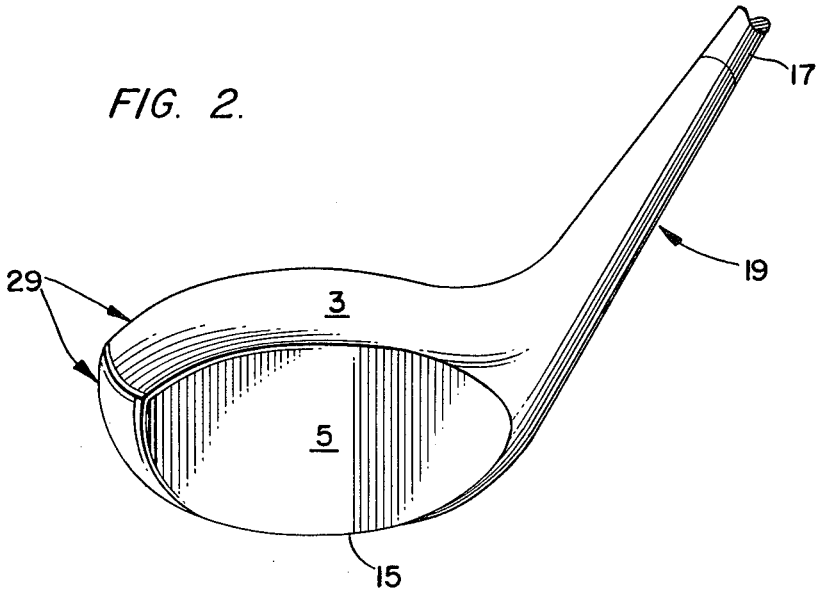

The present invention is directed to club heads known as "woods" and shaped, traditionally, as shown in the drawing of the instant disclosure, FIGS. 1 and 2, reference characters 1 and 3 thereof, respectively. In the interest of clarity, the term "woods" will be employed herein, unless otherwise qualified, to refer generically to "club heads" shaped like those in the aforementioned FIGS. 1 and 2, whether they are made of wood (such as persimmon wood), aluminum, plastic, or other compositions.

In this vein, the present discovery is concerned with polyurethane woods—in other words, golf club heads made entirely or predominantly of a urethane polymer.

As is evident from FIGS. 1 and 2, standard woods have a flat leading ball-striking surface called a "face" 5. See FIG. 2. In FIG. 1 the face is provided with multiple, parallel, horizontal grooves 7. Also, as shown in FIG. 1, the face has a center portion 9 (also known as the "sweetspot"), a left side leading portion 11 known as the "toe" and a right side (rear) portion 13 known as the "heel". The bottom of the wood, the leading edge of which only is shown at 15 in FIG. 2, is called a "sole", and the elongated portion extending from the body (block) of the wood 3 of FIG. 2 to the shaft 17 (cutaway section only shown) is called a "neck" 19. The neck has a hollow center (not shown) into which is fitted shaft 17.

The above-mentioned center portion 9 of the wood face 5 shown in FIG. 1 is delineated laterally by two solid slanted lines 21 forming a keystone or frustoconical configuration, which represents a plate called an "insert" (shown only as delineated by lines 21) fitted into a recessed portion (not shown) in the center of the face of the wood, the insert being fastened to the face by screws 23. Of course, it is imperative that the front surface of the insert, and the toe 11 and heel 13 surfaces, provide, overall, a uniformly smooth club face. This minimizes deflection of the golf ball when other than the sweetspot is contacted by the ball.

The object of the insert is to provide more durability and more distance, the insert being made, in the past, of various materials, including certain metals, ivory, polymers (e.g., phenolics), and the like.

While woods, prior to and since one of golf's immortals, Harry Vardon (1870–1937), have traditionally been made of solid wood blocks, more recent technology has introduced an alternative structure for these blocks which comprises stacked thin wooden sheets firmly laminated by means of interposed thin films of adhesive resins. The resulting stack is then shaped into a wood.

While this alternative has met with significant success, other alternative materials used to make woods have not fared as well, for various reasons. Woods have been made of, for example, aluminum, plastics [acrylonitrile-butadiene-styrene (ABS)], and other metals and polymers. Players using them found the manufacturers' alleged increase in distance questionable; players have complained of an uncomfortable feel at impact and loss of control and accuracy; players reported, for instance, feelings of so-called "shock" at impact and shorter contact (club face/golf ball contact), even for shots perfectly hit; and players were annoyed with vibrations and resultant loss of distance when, at impact, the wood's sweetspot was not met, i.e., when the ball was struck toward or on the toe or the heel of the wood. They often described the just-mentioned difference in control and accuracy between traditional woods and the just-described commercially unsuccessful woods as similar to the difference in feel at impact most players experience between their long irons (1 or 2) and their short irons (6–9). Present-day irons are numbered 1–9, the number 1 iron being the longest and the number 9 iron being the shortest.

As is well known, besides having longer shafts, the long irons have lighter, thinner, and narrower heads than the short irons, and less loft. The longer, less-lofted irons remain in briefer contact with the ball than the more-lofted shorter irons. Short contact times cause increased vibrations; conversely, vibrations diminish as the contact time increases.

The heretofore-mentioned traditional wood and the more recent laminate wood generally have not only an insert of the type discussed supra, and shown in FIG. 1, but, in the interest of durability, a metal sole (bottom) plate, the leading edge only of which is shown at 25 in FIG. 1. Also, various impregnations and coatings are used to protect the wood.

Unfortunately, despite these modifications to the traditional wood block and the laminate woods, the wood is readily damaged. For instance, the face and other surfaces of the wood are quick to bruise and show indentations, and the neck of the wood is prone to crack. A sleeve 27, shown in FIG. 1, usually of plastic material, is conventionally used to cover the mating area of the neck 19 and shaft 17 (as shown in FIG. 2) of the club in order to provide a smooth appearance. This sleeve is likewise prone to cracking.

Even with meticulous craftsmanship and quality control, it is difficult to guarantee reproducibility of a given club head design, including a uniform loft and lie, a uniform club face surface, etc. The art has had to try to master numerous complicated steps (sometimes over 100) to manufacture an acceptable golf club.

Even then, it has yet to overcome severe drawbacks, including club head weight changes due to substantial moisture absorption. Weight changes and the aforedescribed bruises and damages are particularly prevalent problems with fairway woods which are used without tees and subjected to frequent contact with wet grass, roots, or even stones. Generally, the leading edge of the fairway wood is thinner than that of a driver (also called a no. 1 wood) and is more easily damaged, even if the bottom of the wood is protected by a metal sole plate 25 (FIG. 1).

In addition, the above-described elements provided in the sweetspot of the wood face as inserts occasion, particularly when they are fastened by screws, differences in restitution of energy when a golf ball is struck other than directly on the sweetspot. This is why experienced golfers become nostalgic about the earlier no-insert wood face.

From the above commentary, it would seem that, to the experienced player, the optimum in woods would include, inter alia, (i) initial speed and good distance for the golf ball through good restitution of energy, but with minimum shock and vibration, (ii) enhanced control and accuracy monitored by impact feeling, and (iii) durability. Obviously, present-day clubs fail in one or more aspects of these characteristics.

It is a desideratum of the present invention to achieve all of these characteristics, including, in a manufacturing sense, reproducibility of the woods without a multiplicity of steps. As will be seen herein, exceptional goals have been achieved in the present discovery and, surprisingly, without the need for exceptional hardness of materials at point of impact.

A search of relevant art in the U.S. Patent and Trademark Office records revealed the following U.S. patents:

| U.S. Pat. No. | Date | Inventor/s | Assignee |
|---|---|---|---|
| 4,068,849 | 17/I/79 | DiSalvo et al. | Acushnet |
| 3,979,126 | 7/IX/76 | Dusbiber | " |
| 3,966,210 | 29/VI/76 | Rozmus | — |
| 3,937,474 | 10/II/76 | Jepson et al. | Acushnet |
| 3,390,881 | 2/VI/68 | Senne | Voit |

While the first three (3) of the patents are of interest, the Jepson et al. patent is deemed the most pertinent. In this patent a conventional golf club of the type hereinbefore described is shown having an insert ("striking plate") of polyurethane of certain alleged physical and chemical characteristics. See claim 1 of the patent.

As will be obvious, infra, the article of manufacture herein claimed differs materially from that taught by Jepson et al. As a for instance only, the patentees' disclosure is directed exclusively to a polyurethane insert.

Two of the remaining patents uncovered, viz., Dusbiber and DiSalvo et al., are directed to golf balls prepared from, inter alia, diisocyanate monomers. The patent to Rozmus concerns a specially-weighted golf club intended to assist in achieving accuracy. The weights are located in a club head, in each cheek thereof, so to speak, and retained therein with, say, epoxy resin and potting material.

The Senne patent is no more relevant in that it involves, briefly, a wood made, preferably, of a wooden core having a face, the center portion of which is recessed to accept an insert, which core is entirely covered by a polymeric shell, but for the toe and heel of the core. A metal plate is fitted on the polymer-covered sole of the core. Of real interest is the following statement which is in a true sense confirmatory of certain commentary supra: (Senne in col. 2, lines 13–24)

> "Solid clubs molded from synthetic resins have been produced commercially, but by preferred standards of golf club performance they have not been satisfactory. Examples of these plastics are nylon, acrylonitrile-butadiene-styrene copolymers and polycarbonates. Because the density of these plastics is greater (by over 100%) than that of wood, it has been necessary to incorporate a central cavity in the solid plastic head. Major disadvantages of this construction are that they do not produce the desired sound on impact, and its dynamic characteristics, particularly in terms of distance, are not so good as those of a conventional wood club."

INVENTION

The present invention relates to golf club woods (i.e., the heads thereof, as pointed out, supra) which are made of polymeric materials and exhibit excellent performance properties. More particularly, the instant discovery concerns woods of the type shown in FIG. 2 herein and made of certain polyurethanes having physical properties surprisingly suited to the game of golf, as will be seen hereinafter. In point of fact, heretofore-described drawbacks inherent in traditional and non-conventional woods have been essentially obviated. What's more, and quite unexpectedly, properties superior to those of conventional woods have been uncovered in the performance of woods molded from the polyurethane vulcanizates of the present invention.

According to the instant discovery, the aforementioned golf club wood comprises a molded polyurethane which is hard and impact-resistant and which is prepared from a prepolymer made by reacting (i) a diisocyanate selected from an aromatic diisocyanate, an isomer mixture of aromatic diisocyanates, a cycloaliphatic diisocyanate, and a mixture of an aromatic and cycloaliphatic diisocyanate, (ii) a polyalkylene ether glycol and, optionally, depending upon the concentration ratios of (i) and (ii), above, (iii) a glycol having a molecular weight below about 350. The prepolymer is then cured to form the hard, impact-resistant polyurethane vulcanizate.

For example, as will be seen in detail hereinafter, when component (iii) is present in the prepolymer, and certain specific concentrations of all components are present, the resulting prepolymer is cured by admixing therewith an arylene primary diamine curing agent. Alternatively, when concentration ratios of components (i) and (ii) are modified to form the prepolymer, component (iii) being omitted, component (iii), inter alia, can become the curing agent.

The polyurethane vulcanizates herein contemplated have a Shore D hardness (ASTM D 224) in the range of about 50 to about 80, an elongation % at break of at least about 150 and not over about 350 (ASTM D412), a notched IZOD impact (ft. lb./in.) exceeding 4 (ASTM D256), a resiliency percentage exceeding 40, generally between about 40 and about 65, and preferably in the range of between about 43 and about 60. (ISO recommendation D.4662)[1]

[1]Resiliency percentage is measured by the well-known Lüpke impact resiliometer test used by Vanderbilt Laboratory, USA.

Other characteristics of the polymers of the present invention are their yield or recession [millimeters (mm)] and recovery or cancellation properties (percentage-wise). These figures are arrived at by taking samples of the polymers contemplated herein, which samples are in the shape of small cylinders having a height of about 12.7 mm and diameter of 29 mm, and subjecting them to a pressure of 11 kilograms (kg) per square millimeter ($mm_2$) using a steel rod having a diameter of about 1.5 at its semi-spherical end which contacts the aforesaid cylinders. The steel rod is connected to a micrometric dial adjusted to zero when the semi-spherical end is applied to the sample without pressure. Table B, infra, indicates results achieved with polymers illustrative of those herein contemplated. The first line of figures in Table B records the downward movement of the rod into the respective samples, i.e., the deformation, yield or recession after the rod pressure is applied for 30 seconds, and the second line of figures in Table B indicates the percentage of yield cancelled (recovery achieved) 60 seconds after release of rod pressure. According to the instant discovery, a yield exceeding about 0.55 mm is desirable, usually in the range of about 0.57 to about 3.0, preferably about 0.60–2.98. Recovery percentage is generally in the range of about 50 to about 95, preferably about 54 to about 92.

Still another characteristic of elastomeric polyurethanes of the present invention is determined by vibration tests conducted to determine feel at impact, i.e., the so-called shock felt when the club face meets the ball. Cylinders 110 mm long and having a free length of 100 mm and a diameter of 10 mm are fabricated out of the cured polymers herein contemplated and a 0.5 gram miniaturized Endevco accelerometer is stuck at the end of each cylinder. Next, the end is bent by 5 mm before being freed to vibrate freely. Table C, infra, shows the results of these tests in terms of amortization rates as defined by logarithmic decrement applied to recordings of the accelerometer signals as shown by vibration curves of each sample. See explanation following Table C.

Amortization rates in the range of about 4.5 to about 12, preferably about 5.0 to about 11.5, are typical of the elastomeric polymers herein contemplated for use in making woods.

Returning now to the reactants for preparing the elastomeric polyurethanes of the present invention, typical diisocyanate components are toluene-2,4-diisocyanate (TDI), toluene, 2,6-diisocyanate, 4,4'-methylene bis(phenylisocyanate) (MDI), 4,4'-methylene bis(cyclohexylisocyanate), an isomeric mixture of TDI and toluene-2,6-diisocyanate (such as 80% of the former and 20% of the latter), and the like.

Among the polyalkylene ether glycols herein contemplated are polytetramethyleneether glycol (PTMEG), polypropyleneether glycol, and the like. PTMEG, for example, generally has a molecular weight in the range of about 400 to about 3000, preferably about 600 to about 1500, and is prepared by polymerizing tetrahydrofuran (THF). Also useful is a copolymer prepared by polymerizing THF with about 5 to about 40% ethylene oxide, preferably about 30%, to form the copolymer (glycol). Mixtures of these glycols may be used. Broadly, the polyalkyleneether glycols herein contemplated have a molecular weight (MW) in the range of that stated above for PTMEG.

Typical glycol components having a molecular weight below about 350, preferably about 62 to about 200 MW, are 1,3-butanediol, 1,4-butanediol, ethylene glycol, diethylene glycol, trimethylene glycol, 1,2-hexylene glycol, 1,2-cyclohexanediol, and the like.

As suggested above, a prepolymer can be made from the (i) diisocyanate, (ii) polyalkyleneether glycol and (iii) low molecular weight glycol components by blending them thoroughly while reacting same, under anhydrous conditions, at a temperature between about 25° and about 100° C. for a period of 0.5 to eight hours, preferably at a temperature of about 80° C. for a period of 4 hours. The mole ratio of (iii) to (ii) is in the range of about 0.25 to about 3.0, and the mole ratio of (i) to (ii) plus (iii) is in the range of about 1.5 to 1.0::2.0 to 1.0. Optionally, more than one-step blending may be used. The prepolymer thus formed is fluid and may then be cured to form solid polyurethane vulcanizates.

Representative curing agents for these prepolymers are arylene primary diamines, such as 4,4'-methylene bis(2-chloroaniline, 4,4-methylene bis(2-carbomethoxyaniline), 4,4'-diaminodiphenyldisulfide, 4,4'-diaminodiphenylsulfone, mixtures of these components, and the like. It is obvious that the arylene diamines are those in which each of the two primary amino moieties is attached directly to a separate arylene moiety. Also, a complex which is prepared by thoroughly mixing methylene dianiline with NaCl in water, or a solvent therefor, may be employed as a curing agent. Generally, the complex is formed by combining about 3 moles of the methylene dianiline component with 1 mole of the salt component.

Curing of the aforementioned three-component prepolymers is best achieved by admixing the curing agent with the fluid prepolymer and in a temperature range of about 25° C. to about 135° C., preferably about 100° C. Usually, and preferably, 3 hours is the length of time allowed for curing, but from about 1 to about 24-hour curing times can be effective, depending upon the temperature employed. Higher temperatures accelerate curing.

Stoichiometrically, sufficient of the curing agent should be present to react with about 50 to about 110% of the free isocyanato moieties in the prepolymer.

EXAMPLES

The following examples are intended to be illustrative only and not limiting to the scope of the present invention:

Example I

One mole of 1000 MW polytetramethyleneether glycol (PTMEG), 1 mole of 1,3-butanediol (BDO), and 4 moles of toluene-2,4-diisocyanate (TDI) are blended, under substantially anhydrous conditions, at a temperature of 80° C. for 4 hours, whereupon a stable fluid prepolymer is formed. The resulting prepolymer (100 parts at 100° C.) is thoroughly mixed with 30 parts of 4,4'-methylene bis(2-chloroaniline)—at 120° C.—and placed in a conventional metal mold (pre-heated to 100° C.) shaped like a standard commercial wood (driver) known as a Wilson X31.[2] The mold is then heated in an oven at a temperature of 100° C. for 3 hours. Upon cooling the mold, the molded club head is removed. Of course, it is shaped like the aforementioned Wilson X31.

[2]Wilson X31 is a golf club model of very good quality made by the Wilson Sporting Goods Company, USA.

In order to duplicate the weight of the just-mentioned commercial wood, sufficient of the molded product is filed off at location 29 of FIG. 2 of the drawing to match the 205 gram weight of the driver, including its insert as shown in FIG. 1. The very same shaft used in the commercial wood is fitted into the molded head, whereby the total weight of 370 grams of the commercial driver and its swing weight of 20.6 are duplicated.

Example II

Example I is repeated in every essential respect with the exception that the mole ratios of the prepolymer components are as follows and only 23 parts of 4,4'-methylene bis(2-chloroaniline) is used:

| | |
|---|---|
| PTMEG | 1.0 mole |
| BDO* | 0.33 mole |
| TDI | 2.67 mole |

*1,3-butanediol

Example III

Example I is repeated in every essential respect, with the exception that 12 parts of 4,4'-methylene bis(cyclohexylisocyanate) is admixed with 88 parts of the prepolymer before curing.[3] The resulting cycloalkyl isocyanate-treated prepolymer is then cured with about a chemical equivalent of 4,4'-methylene bis(2-chloroaniline) curing agent, i.e., an amount of the curing agent sufficient to react with the free isocyanato moieties in the thus-treated prepolymer.

[3]In general, 5–30 parts by weight of the cycloaliphatic diisocyanate per 95–70 parts of the prepolymer is used, the prepolymer being prepared as taught hereinabove and illustrated in Example I, supra.

Example IV

One mole of 650 MW PTMEG is reacted with 5 moles of 4,4'-methylene bis(phenylisocyanate), under substantially anhydrous conditions and at a temperature of 110° C. for 3.5 hours. The resulting fluid prepolymer is then cured with 1,4-butandediol (BDO) at a temperature of 95° C. for 5 hours, the BDO being thoroughly mixed with the prepolymer and present in sufficient amount to provide about 95% of the chemical equivalent of BDO to the free isocyanato moieties in the prepolymer.[4] Of course, to form the wood of Example I, supra, curing is carried out in a mold. Shore D hardness is 70.

[4]In general, the prepolymer is prepared with 3–6 M of the diisocyanate per mole of the glycol and cured with the lower MW glycol present in the concentration of 95%–100% based upon the isocyanato moieties. Curing is in the temperature range of 90°–120° C.

Example V

Example IV is repeated in every essential respect except that the curing agent is the bis(beta-hydroxyethyl ether) of hydroquinone.

Illustrative properties of the hard, impact-resistant polyurethane vulcanizates prepared as taught in the above examples are given in the following tables, the procedures used being those defined hereinbefore:

TABLE A

| Test | Example I | Example II | Example III |
|---|---|---|---|
| Shore D hardness | 70 | 53 | 77 |
| Elongation at break, % | 270 | 315 | 230 |
| Notched IZOD impact | 15 | —[5] | 6.5 |
| Resiliency (Lupke) | 51 | 47 | 57 |

[5]Did not break when using the maximum impact employed under ASTM D256.

TABLE B

| Test | Example I | Example II | Example III |
|---|---|---|---|
| Recession (mm) | 0.91 | 2.96 | 0.63 |
| Recovery, % | 68.50 | 90.00 | 56.00 |

TABLE C

| Test | Example I | Example II | Example III |
|---|---|---|---|
| $\frac{X1}{X2}$ | $\frac{17.5}{11}$ | $\frac{22}{11}$ | $\frac{24}{17}$ |
| $\delta = \log \frac{X1}{X2} \times 2.3$ | 0.4637 | 0.6923 | 0.3444 |
| $\alpha = \frac{\delta}{2\pi}$ | 0.0738 | 0.1102 | 0.0548 |

TABLE C-continued

| Test | Example I | Example II | Example III |
|---|---|---|---|
| Amortization, % | 7.4 | 11.02 | 5.5 |

As indicated heretofore, a cylinder of the cured polyurethane is fitted at one end with an Endevco accelerometer and that same end of the cylinder is bent to a predetermined distance (in mm) and then freed. Signals given off by the accelerometer during vibration of the cylinder are recorded as vibration curves. The heights of the first and second apex of any given recording curve are reported as X1 and X2, respectively, and amortization percentage computed as shown in Table C, above.[6]

[6]Tests conducted by the well-known Sopemea Company in its French laboratories.

Tests conducted comparing polyurethane vulcanizates of Examples I–III, supra, with other polymeric materials and a persimmon wood used for best solid drivers without inserts show unexpected properties of vulcanizates. Table D, below, and the commentary succeeding same put the present invention in true perspective, it is earnestly felt.

Of the other polymers tested, one is defined by E. I. duPont de Nemours, Wilmington, Del., USA, and identified as L167. Its physical properties are reported by DuPont as follows:

| | |
|---|---|
| Nominal NCO (isocyanate) content, % | 6.3 |
| Specific gravity | 1.07 |
| Working life, minutes | 5 |
| Curing system[7] | 19.5 |
| 100% Modulus (psi) | 1800 |
| Tensile strength, (psi) | 5000 |
| Elongation, % | 450 |
| Compression set (A) 1350 psi | 10 |
| Shore D hardness | 48 |
| Resiliency | 39 |
| Abrasion, NBS index | 275 |
| Notched IZOD impact, ft. lbs./in. | — (Cf. ftn. 5, supra) |

L167 is a polyurethane vulcanizate.

[7]4,4'-methylene bis(2-chloroaniline) pts./100 pts. prepolymer.

Another polyurethane elastomer tested is identified as ISP (instant set polyurethane) produced by Dow Chemical Company, Michigan, USA. Its physical properties are reported as follows: tensile strength, psi 8500; tensile modulus, psi 314,000; elongation, % 15; compression strength, psi 9200; and IZOD impact ft.lb./in. of notch 1. The first three properties are reported as determined by ASTM procedure D638. Compression strength and notched IZOD impact are reported as determined by ASTM procedures D695 and D256, respectively.

Still another polymer tested is the aforementioned ABS (acrylonitrile/butadiene/styrene) of commercial quality and having a tensile strength, psi, of 6000 and an elongation, %, of 35, both tested using ASTM D638 procedure.

The following table records physical properties of the just-mentioned ISP and ABS polymers and the aforementioned persimmon wood, the properties being those determined by tests identified hereinbefore:

TABLE D

| Test | ISP | ABS | SAMPLE[8] |
|---|---|---|---|
| Shore D hardness | 77 | 81 | 77 |

TABLE D-continued

| Test | ISP | ABS | SAMPLE[8] |
|---|---|---|---|
| Resiliency (Lupke) | 58 | 55 | 36 |
| Recession (mm) | 0.49 | 0.47 | 0.64 |
| Recovery, % | 41 | 33.4 | 29.7 |
| $\frac{X1}{X2}$ | $\frac{40.5}{34}$ | $\frac{50.5}{41.5}$ | $\frac{44}{30}$ |
| $\delta = \log \frac{X1}{X2} \times 2.3$ | 0.1747 | 0.1960 | 0.3825 |
| $\delta = \frac{\delta}{2\pi}$ | 0.0278 | 0.0312 | 0.0608 |
| Amortization, % | 2.8 | 3.1 | 6.1 |

[8]SAMPLE: made from a solid piece of persimmon wood, without insert, as heretofore mentioned.

Tests under playing conditions reveal quite convincingly that the desiderata heretofore mentioned have been achieved, using the specific polyurethane vulcanizates of the present invention. The reasons for convincing successes are not fully understood, but the data accumulated admit of certain conclusions and very reasonable hypotheses.

Heretofore, the art had concentrated on hardness of materials in order to realize initial speed and greater distance through good restitution of energy. It has been found that other factors are important criteria to be considered when evaluating materials for use in making good woods.

For example, drivers made out of the polymers prepared according to Examples I–III and tested by experienced average golfers and top-flight golfers are reported as superior, as to feelings of shock and vibration experienced at impact, i.e., when striking the golf ball, to the other woods tested and reported in Table D, above, and especially the wood made of ABS which is the hardest and exhibits the lowest yield under pressure of all woods tested, as shown in the above tables. The ISP wood is hardly better than the ABS wood. It is noteworthy that both of these lastmentioned woods exhibit the lowest yields (recession) and the lowest percent amortization of all clubs tested.

In point of fact, as to a cushioned feeling at impact the aforementioned golfers report woods made out of the elastomers of Example I and II superior to, and woods manufactured out of the elastomer of Example III on a par with, the commercial woods. Again, the yield and amortization figures in the above tables demand scrutiny.

The woods prepared as in Examples I–III, supra, compared extremely favorably distance-wise with commercial woods;[9] in fact, the Example I and Example III woods outdistanced the commercial woods. Hardness and resiliency are deemed telling factors, in that, referring to Table A, above, the hardest and most resilient woods outdistanced the remaining woods, with the softest and least resilient woods (Example II) still comparing favorably with the commercial, very good quality woods.

[9]Commercial woods used for these actual-playing-conditions tests are high-quality drivers, with inserts.

As indicated heretofore, the excellent results obtained under actual playing conditions are not fully understood. For instance, comparing the hardness and resiliency of Example II in Table A with these properties of the Wood in Table D, it is possible that the hardness of the Wood compensates for its low resiliency. However, the favorable results with the just-mentioned Example II woods, which are considerably softer, would suggest that another factor is involved which leads to a good restitution of energy, such factor being, perhaps, some dynamic equivalent to the static recovery figures shown in Table B and Table D, above.

Surprisingly, despite their relative softness and lower resiliency, there is not much less restitution of energy and no outstanding difference in distances achieved between the woods made according to Examples I–II, above, and the woods manufactured pursuant to Example III, above. Woods made out of the L167 polyurethanes are, however, considered too soft by the average experienced golfer and the top-flight golfer.

It is interesting to note that, much as in the case of high compression (hardness) and low compression golf balls, top-flight players, i.e., players who hit the ball considerably harder than the average golfer, prefer the Examples I and III woods because of increased distance. The experienced average golfer is more comfortable with the softer balls and woods and he achieves about the same distances with them as with the harder balls and woods.

The above-described reduction of shock and vibration and improved impact feeling are credited with enhanced accuracy realized with the woods of the present invention. In fact, the aforementioned golfers report the accuracy as superior to that of the high quality commercial woods tested. Of course, it has to be appreciated that the restitution of energy will vary significantly along the face of a commercial wood bearing an insert.

It is to be expected, also, to find differences in accuracy, e.g., dispersion in length and/or direction, between balls struck in the sweetspot and balls struck off center. Top-flight golfers also agree that the woods of the instant discovery reduced the tendency to hook or slice involuntarily.

Very surprising, also, is the report by these golfers that control of the ball with these woods is equally as good as that with the grooved commercial clubs (FIG. 1), even though no grooves are used in the invention woods (FIG. 2). It is hypothesized that the yield of the face of the polymeric woods of the instant discovery at impact and the resultant slightly longer period of contact with the golf ball make it possible to eliminate grooves and still impart intentional spin to the ball, such as that needed to achieve a voluntary slice or hook, or to increase or decrease trajectory.

In this vein, top-flight and experienced average golfers alike report that slightly higher trajectories are observed with the present woods as compared with the high quality commercial woods tested. This is so in spite of the absence of a metal sole on the invention wood, which metal sole is considered a factor in producing higher trajectories. Of course, this unexpected feature of the invention woods is most desirable in fairway woods when an attempt is made to lift a ball out of long grass (the rough) or a hard surface, such as ground or a hard matted grass lie.

Another advantage to the higher trajectories reported using the woods (drivers) tested is that the loft of a wood can be diminished with resultant increase in distance.

Incident to the aforediscussed tests under actual playing conditions are observations as to the durability of the woods of the present invention. After extensive use of these woods (driver they are essentially free of abrasions or other marks common to standard woods. This is true of the bottom of the woods, also, even though no plate is affixed thereto as in the case of standard commercial woods which generally carry a metal protective plate. It stands to reason that this characteristic of the invention woods will be even more advantageous as to fairway woods than drivers, what with the fact that no tee is used and the former encounter hard ground, roots, stones, damp grass, and abrasive and impact conditions. Also observed is the fact that there is no change of weight or shape of the invention woods, and no cracks appear in the necks thereof after extensive use. Such is not the case with the ISP woods, which exhibited, very early in the tests, cracks in their neck portion.

Of course, the manufacturing advantages of the invention woods also are unprecedented. For instance, reproducibility is a fact with the molded heads of the instant discovery, and not just a goal. It is even possible to obtain a constant diameter and a well-defined axis for the shaft hole in relation to the face of the club, thus always producing the same desired loft and lie angles with a given mold. This is so difficult to do by machining. Of great significance is the fact that the multiple operations presently required in the manufacture of today's wood are reduced to a minimum. Easier by far, also, is fitting the shaft into the hole provided therefor in the neck of the wood, what with the fact that the polyurethane vulcanizates herein contemplated manifest good resilience as contrasted with, say, natural wood.

Another plus indigenous to the woods herein contemplated is that they can be impregnated, before curing, with different colors. Of course, they can be painted. Also, by using various surface finishes in the interior of the mold—e.g., textured, smooth, and like finishes—aesthetically appealing woods can be readily fashioned.

In addition, for heavier fairway clubs or for drivers with small heads, a loading in any desired place in the wood can be accomplished. Such a loading may take the form of copper screws, for instance, which the aforementioned characteristics of the polyurethane vulcanizates herein contemplated will accommodate and retain in place far better than natural wood.

It is well known that the sound heard by a golfer when his club face strikes the ball is important to him or her, and it more often than not determines the acceptance or rejection of a given type of golf ball, and even the club itself. Issued patents often allude to this sound as final proof of a good result. Interestingly enough, the molded woods of the present discovery are deemed by the hereinbefore-mentioned golfers as very satisfactory as to their sound characteristics. In fact, they are heard to state that the sound of the Example III woods is superior to that of the high quality commercial woods tested.

Pursuant to statutory requirements, there are described above the invention and what are now considered its best embodiments. It should be understood, however, that the invention can be practiced otherwise than as specifically described above and still be within the scope of the appended claims.

What is claimed is:

1. A one-piece solid molded polyurethane vulcanizate golf club head having a unitary body including the entire front striking face and exhibiting the properties of a Shore D hardness in the range of about 50 to about 80, an elongation % at break of at least about 150 and not over about 350, a notched IZOD impact (ft. lb./in.) exceeding 4, a resiliency percentage exceeding 40, a recession characteristic exceeding about 0.55 mm, a recovery % between about 50–95, and an amortization % between about 4.5 and about 12; said polyurethane vulcanizate being a cured prepolymer, the prepolymer comprising the reaction product of (i) a diisocyanate selected from an aromatic diisocyanate, an isomer mixture of aromatic diisocyanates, a cycloaliphatic diisocyanate, and a mixture of an aromatic and cycloaliphatic diisocyanate, (ii) a polyalkylene ether glycol, and (iii) a low molecular weight (MW) glycol below about 350, the curing agent being an arylene primary diamine, the mole ratio of component (iii) to (ii) being in the range of about 0.25 to about 3.0, and the mole ratio of component (i) to (ii) plus (iii) being in the range of about 1.5 to 1.0::2.0 to 1.0, and the stoichiometric concentration of curing agent being sufficient to react with about 50 to 110% of the free isocyanato moieties in the prepolymer.

2. The article of claim 1 having a recession characteristic in the range of about 0.57 and about 3.0 mm, a recovery % between about 54–92, and an amortization % between about 5.0 and 11.5.

3. The article of claim 2 wherein the polyurethane vulcanizate is a cured prepolymer, the prepolymer comprising the reaction product of 4,4'-methylene bis(-phenylisocyanate) with a polyalkyleneether glycol in the concentration ratio of 3–6 moles of the former to 1 mole of the latter, and the curing agent is selected from a low molecular weight glycol having a MW below about 350, the curing agent being present in the concentration of about 95%–100% chemical equivalent, based upon the free isocyanato moieties in the prepolymer.

4. The article of claim 2 having a recession characteristic in the range of about 0.60 and about 2.98.

5. A golf club head in accordance with claim 2 in combination with a golf shaft.

6. The article of claim 1 wherein component (ii) has a MW in the range of about 400 to about 3000, and component (iii) has a MW in the range of about 62 to about 200.

7. The article of claim 6 wherein component (i) is toluene-2,4-diisocyanate (TDI), (ii) is polytetramethyleneether glycol (PTMEG), (iii) is 1,3-butanediol, and the curing agent is 4,4'-methylene bis(2-chloroaniline).

8. The article of claim 6 wherein present in the prepolymer, in addition to components (i)–(iii), are 5–30 parts by weight of a cycloaliphatic diisocyanate per 95–70 parts by weight of said components.

9. The article of claim 8 wherein the additional component is 4,4'-methylene bis (cyclohexyl isocyanate).

10. A golf club head in accordance with claim 1 in combination with a golf shaft.

* * * * *